US005634886A

United States Patent [19]

Bennett

[11] Patent Number: 5,634,886

[45] Date of Patent: Jun. 3, 1997

[54] CPR DEVICE

[76] Inventor: Michael K. Bennett, 4160 Ernestine, North Highlands, Calif. 95660

[21] Appl. No.: 567,965

[22] Filed: Dec. 6, 1995

[51] Int. Cl.[6] ..... A61H 31/00

[52] U.S. Cl. ..... 601/41; 601/106; 601/134

[58] Field of Search ..... 601/1, 41–44, 601/106–108, 134, 135; 417/510, 520

[56] References Cited

U.S. PATENT DOCUMENTS

| | | | |
|---|---|---|---|
| 2,484,306 | 10/1949 | McClain et al. | 601/41 |
| 3,241,551 | 3/1966 | Tambascia | 601/41 |
| 3,489,140 | 1/1970 | Mullikin | 601/41 |
| 3,739,771 | 6/1973 | Gaquer et al. | 601/41 |
| 5,327,887 | 7/1994 | Nowakowski | 601/41 |
| 5,399,148 | 3/1995 | Waide et al. | 601/41 |
| 5,403,269 | 4/1995 | Kennedy | 482/122 |

FOREIGN PATENT DOCUMENTS

| | | | |
|---|---|---|---|
| 9119473 | 12/1991 | WIPO | 601/41 |

*Primary Examiner*—Jeanne M. Clark

[57] ABSTRACT

A CPR device comprised of a hollow upper T-shaped housing. A hollow lower housing is coupled with the upper T-shaped housing. A plunging mechanism extends downwardly through the upper T-shaped housing and outwardly of the lower housing. An end portion of the plunging mechanism has a plunger secured thereto.

1 Claim, 3 Drawing Sheets

CPR DEVICE

BACKGROUND OF THE INVENTION

1. Field of the Invention

The present invention relates to a CPR cardiopulminary resuscitation device and more particularly pertains to providing automatic timed articulation of a plunger member for effecting resuscitation of a patient with a CPR device.

2. Description of the Prior Art

The use of resuscitation devices is known in the prior art. More specifically, resuscitation devices heretofore devised and utilized for the purpose of administering CPR to a patient are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,915,095 to Chun discloses cardiac CPR mechanism.

U.S. Pat. No. 4,863,385 to Pierce discloses a cardiopulmonary resuscitation (CPR) sequencer.

U.S. Pat. No. 4,019,501 to Harris discloses a CPR breastplate compression aid.

U.S. Pat. No. 4,349,015 to Alferness discloses a manually-acutable CPR apparatus.

U.S. Pat. No. 4,297,999 to Kitrell discloses a portable resuscitation apparatus.

While these devices fulfill their respective, particular objective and requirements, the aforementioned patents do not describe a CPR device for providing automatic timed articulation of a plunger member for effecting resuscitation of a patient.

In this respect, the CPR device according to the present invention substantially departs from the conventional concepts and designs of the prior art, and in doing so provides an apparatus primarily developed for the purpose of providing automatic timed articulation of a plunger member for effecting resuscitation of a patient.

Therefore, it can be appreciated that there exists a continuing need for new and improved CPR device which can be used for providing automatic timed articulation of a plunger member for effecting resuscitation of a patient. In this regard, the present invention substantially fulfills this need.

SUMMARY OF THE INVENTION

In the view of the foregoing disadvantages inherent in the known types of resuscitation devices now present in the prior art, the present invention provides an improved CPR device. As such, the general purpose of the present invention, which will be described subsequently in greater detail, is to provide a new and improved CPR device and method which has all the advantages of the prior art and none of the disadvantages.

To attain this, the present invention essentially comprises a hollow upper T-shaped housing having a horizontal portion and a vertical portion. The vertical portion extends downwardly from a midpoint of the horizontal portion. The horizontal portion has vented end portions. The vertical portion has an internally threaded open lower end. The open lower end has an upper circular casing secured around a periphery thereof. The horizontal portion has a pair of securement portions secured to an upper surface thereof. The device includes a hollow lower housing having a vertical portion. The vertical portion has an externally threaded open upper end and an open lower end. The externally threaded open upper end is adjustably coupled with the internally threaded lower end of the vertical portion of the upper T-shaped housing. The open lower end of the lower housing has a lower circular casing secured around a periphery thereof. The device includes a plunging mechanism comprised of a pair of motors secured within the vented end portions of the horizontal portion of the upper T-shaped housing. The plunging mechanism has a cam shaft rotatably extending between the two motors. The cam shaft has a cam in a midpoint thereof. The plunging mechanism has a plunger shaft secured to the cam. The plunger shaft extends downwardly through the vertical portion of the upper T-shaped housing and outwardly of the open lower end thereof and extending through the vertical portion of the lower housing and outwardly of the open lower end thereof. An end portion of the plunging mechanism has a plunger secured thereto. A pair of bands are secured to the pair of securement portions of the horizontal portion of the upper T-shaped housing.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is therefore an object of the present invention to provide a new and improved CPR device which has all the advantages of the prior art resuscitation devices and none of the disadvantages.

It is another object of the present invention to provide a new and improved CPR device which may be easily and efficiently manufactured and marketed.

It is a further object of the present invention to provide a new and improved CPR device which is of durable and reliable construction.

An even further object of the present invention is to provide a new and improved CPR device which is susceptible of a low cost of manufacture with regard to both materials and labor, and which accordingly is then susceptible of low prices of sale to the consuming public, thereby making such a CPR device economically available to the buying public.

Still yet another object of the present invention is to provide a new and improved CPR device which provides in the apparatuses and methods of the prior art some of the advantages thereof, while simultaneously overcoming some of the disadvantages normally associated therewith.

Even still another object of the present invention is to provide a new and improved CPR device for providing automatic timed articulation of a plunger member for effecting resuscitation of a patient.

Lastly, it is an object of the present invention to provide a new and improved CPR device comprised of a hollow upper T-shaped housing. A hollow lower housing is coupled with the upper T-shaped housing. A plunging mechanism extends downwardly through the upper T-shaped housing and outwardly of the lower housing. An end portion of the plunging mechanism has a plunger secured thereto.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
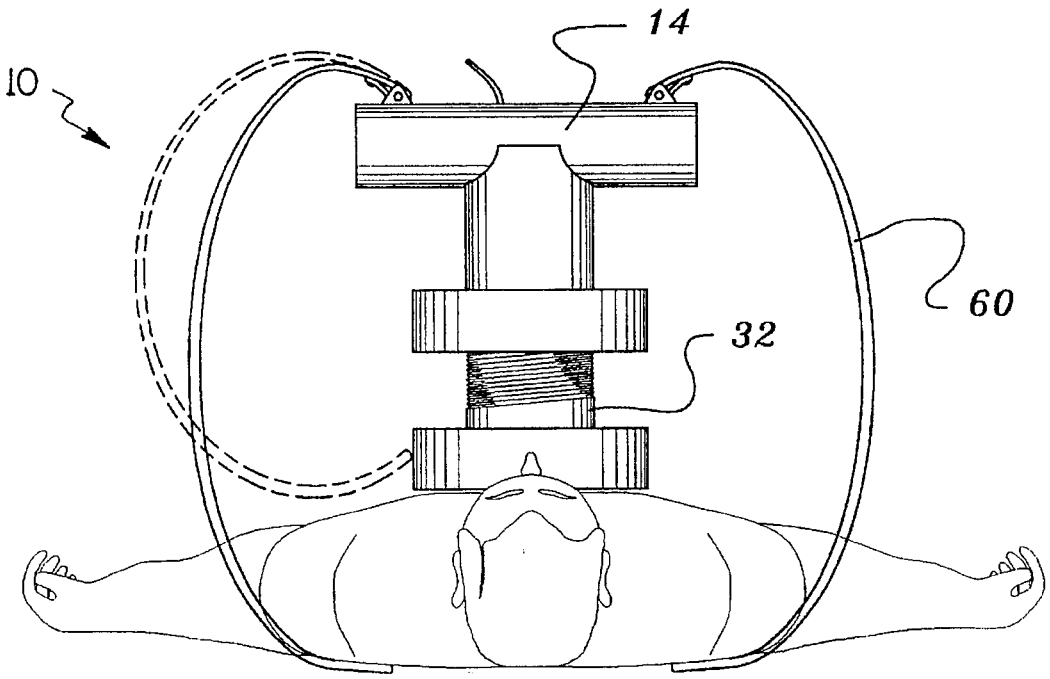
FIG. 1 is a perspective view of the preferred embodiment of the CPR device constructed in accordance with the principles of the present invention.
Figure 2:
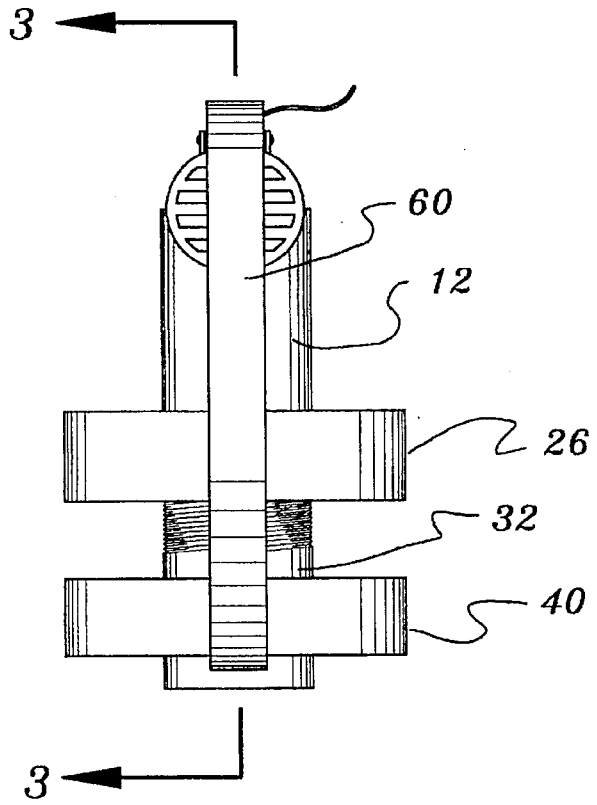
FIG. 2 is a side elevation view of the present invention.
Figure 3:
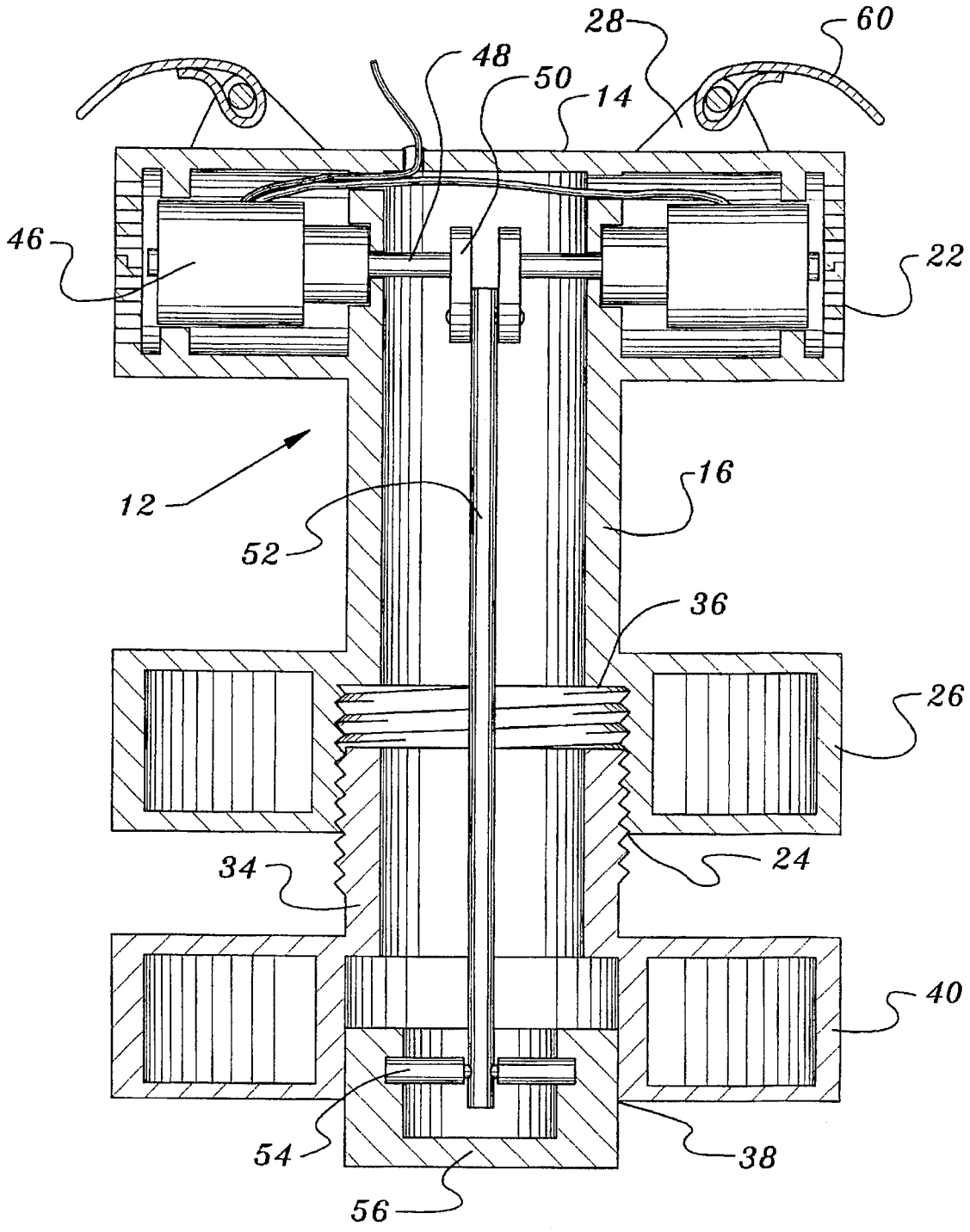
FIG. 3 is a cross-sectional view as taken along line 3—3 of FIG. 2.
Figure 4:
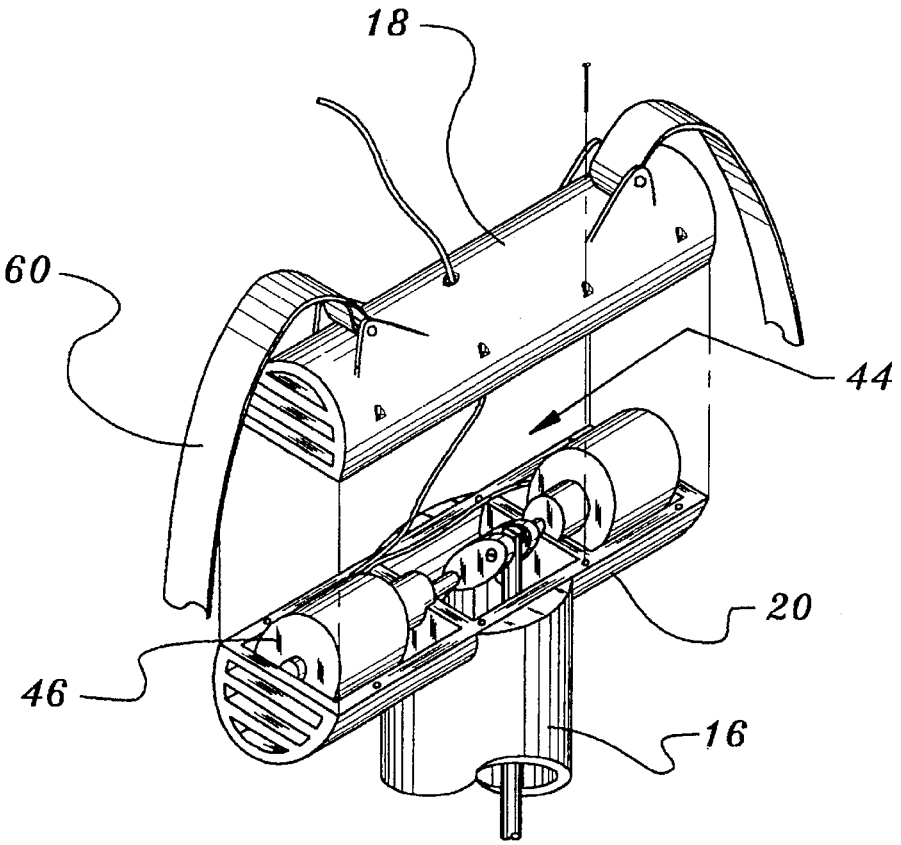
FIG. 4 is a perspective view of the upper T-shaped housing of the present invention.
Figure 5:
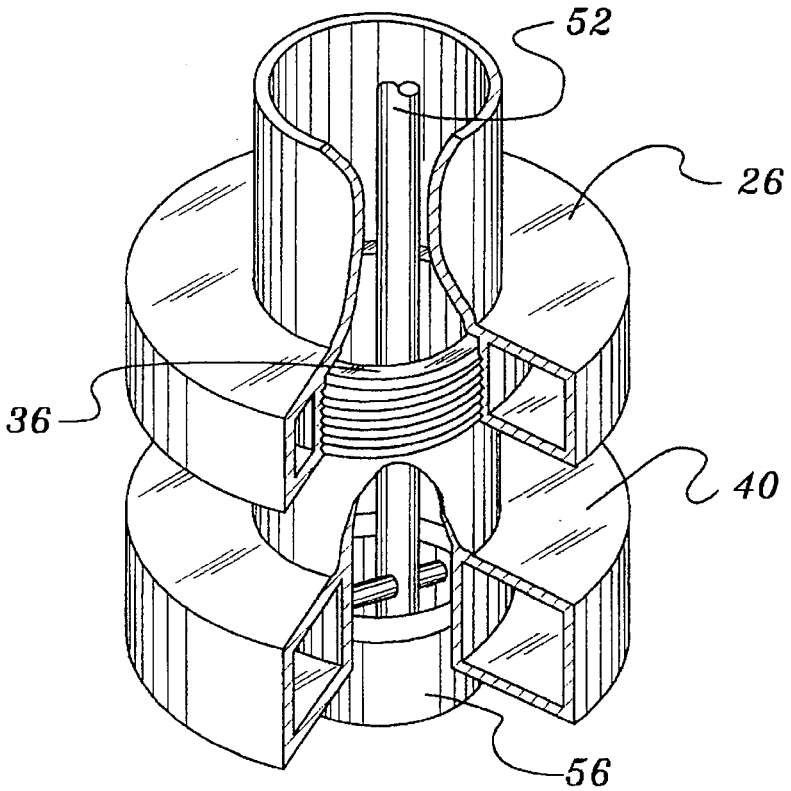
FIG. 5 is a perspective view of the lower T-shaped housing of the present invention.

With reference now to the drawings, and in particular, to FIGS. 1–5 thereof, the preferred embodiment of the new and improved. CPR device embodying the principles and concepts of the present invention and generally designated by the reference number 10 will be described.

Specifically, it will be noted in the various Figures that the device relates to a new and improved CPR device for providing automatic timed articulation of a plunger member for effecting resuscitation of a patient. In its broadest context, the device consists of a hollow upper T-shaped housing, a hollow lower housing, a plunging mechanism, and a pair of bands. Such components are individually configured and correlated with respect to each other so as to attain the desired objective.

The device 10 includes a hollow upper T-shaped housing 12 having a horizontal portion 14 and a vertical portion 16. The horizontal portion 14 is comprised of an upper portion 18 and a lower portion 20. The upper portion 18 and the lower portion 20 are easily secured together by screws. The vertical portion 16 extends downwardly from a midpoint of the lower portion 20 of the horizontal portion 14. The horizontal portion 14 has vented end portions 22. The vertical portion 16 has an internally threaded open lower end 24. The open lower end 24 has an upper circular casing 26 secured around a periphery thereof. The horizontal portion 14 has a pair of securement portions 28 secured to the upper portion 18 thereof.

The device 10 includes a hollow lower housing 32 having a vertical portion 34. The vertical portion 34 has an externally threaded open upper end 36 and an open lower end 38. The externally threaded open upper end 36 is adjustably coupled with the internally threaded lower end 24 of the vertical portion 16 of the upper T-shaped housing 12. The open lower end 38 of the lower housing 32 has a lower circular casing 40 secured around a periphery thereof.

The device 10 includes a plunging mechanism 44 comprised of a pair of motors 46 secured within the vented end portions 22 of the horizontal portion 14 of the upper T-shaped housing 12. The plunging mechanism 44 has a cam shaft 48 rotatably extending between the two motors 46. The cam shaft 48 has a cam 50 in a midpoint thereof. The plunging mechanism 44 has a plunger shaft 52 secured to the cam 50. The plunger shaft 52 extends downwardly through the vertical portion 16 of the upper T-shaped housing 12 and outwardly of the open lower end 24 thereof and extending through the vertical portion 34 of the lower housing 32 and outwardly of the open lower end 38 thereof. An end portion 54 of the plunging mechanism 52 has a plunger 56 secured thereto. The motors 46 are preset as to the number of compressions per minute. The lower circular casing 40 is placed on the chest of a patient in the exact position as the hands would be while performing CPR. Once the device is activated, the motors rotate the cam shaft 48 and the cam 50, the cam 50 forces the plunger shaft 52 and the plunger 56 against the sternum of the patient. The depth of the compression can be varied by adjusting the amount the plunger 56 extends outwardly of the lower circular housing 40.

This is simply accomplished by adjusting the amount that the lower housing 32 is coupled within the open lower end 24 of the upper T-shaped housing 12.

Lastly, a pair of bands 60 are secured to the pair of securement portions 28 of the horizontal portion 14 of the upper T-shaped housing 12. The pair of bands 60 secure around the patient to hold the device 10 in place upon the patient's chest. The preferred construction of the bands is steel so as not to inhibit the breathing in any manner.

In an alternate embodiment of the invention, there is a strap attached to the end of one of the bands 60. The strap is then pulled around the back of the victim or subject. The loose end of the strap is then looped through an attachment similar to a belt loop for a pair of pants. The strap is then pulled snugly around the victim or subject, and attached to itself by means of a pile type fastener such as Velcro. This will allow the victim or subject space for breathing and still hold the C.P.R.U. snug against the sternum.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing iS considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A cardiopulmonary resuscitation device for providing automatic timed articulation of a plunger member for effecting resuscitation of a patient comprising, in combination:

a hollow upper T-shaped housing having a horizontal portion and a vertical portion, the vertical portion extending downwardly from a midpoint of the horizontal portion, the horizontal portion having vented end portions, the vertical portion having an internally threaded open lower end, the open lower end having an upper circular casing secured around a periphery thereof, the horizontal portion having a pair of securement portions secured to an upper surface thereof;

a hollow lower housing having a vertical portion, the vertical portion having an externally threaded open upper end and an open lower end, the externally threaded open upper end adjustably coupled with the internally threaded lower end of the vertical portion of the upper T-shaped housing, the open lower end of the lower housing having a lower circular casing secured around a periphery thereof;

a plunging mechanism comprised of a pair of motors secured within the vented end portions of the horizontal portion of the upper T-shaped housing, the plunging mechanism having a cam shaft rotatably extending between the two motors, the cam shaft having a cam in a midpoint thereof, the plunging mechanism having a plunger shaft secured to the cam, the plunger shaft extending downwardly through the vertical portion of the upper T-shaped housing and outwardly of the open lower end thereof and extending through the vertical portion of the lower housing and outwardly of the open lower end thereof, an end portion of the plunging mechanism having a plunger secured thereto;

a pair of expandable bands secured to the pair of securement portions of the horizontal portion of the upper T-shaped housing, the pair of expandable bands having free ends positionable beneath and abutting shoulder blades of the patient to effect coupling of the device to the patient.

* * * * *